US009103640B2

(12) United States Patent
Sexton

(10) Patent No.: US 9,103,640 B2
(45) Date of Patent: Aug. 11, 2015

(54) METHOD FOR THE SIMULTANEOUS DISPERSION OF PROJECTILES

(76) Inventor: Richard F. Sexton, Miami, FL (US)

( * ) Notice: Subject to any disclaimer, the term of this patent is extended or adjusted under 35 U.S.C. 154(b) by 0 days.

(21) Appl. No.: 13/261,651

(22) PCT Filed: Nov. 9, 2010

(86) PCT No.: PCT/US2010/002931
§ 371 (c)(1),
(2), (4) Date: May 6, 2013

(87) PCT Pub. No.: WO2012/064313
PCT Pub. Date: May 18, 2012

(65) Prior Publication Data
US 2013/0255526 A1 Oct. 3, 2013

(51) Int. Cl.

| | |
|---|---|
| ***F42B 12/22*** | (2006.01) |
| ***F42B 12/56*** | (2006.01) |
| ***F42B 5/03*** | (2006.01) |
| ***F42B 7/02*** | (2006.01) |
| ***F42B 12/58*** | (2006.01) |

(52) U.S. Cl.
CPC . *F42B 12/56* (2013.01); *F42B 5/03* (2013.01); *F42B 7/02* (2013.01); *F42B 12/58* (2013.01)

(58) Field of Classification Search
CPC ..... F42B 30/02; F42B 12/58; F42B 12/62
USPC ..... 102/438, 439, 501, 504, 506
See application file for complete search history.

(56) References Cited

U.S. PATENT DOCUMENTS

| | | | | | |
|---|---|---|---|---|---|
| 15,369 | A | | 7/1856 | Buckel et al. | |
| 122,620 | A | | 1/1872 | Maduell | |
| 216,974 | A | | 7/1879 | Rice | |
| 221,249 | A | * | 11/1879 | Nowlan | 102/506 |
| 275,674 | A | | 4/1883 | Littlepage | |
| 588,764 | A | | 8/1897 | Boss | |
| 620,875 | A | * | 3/1899 | Baker | 102/506 |
| 791,679 | A | * | 6/1905 | Edmunds | 102/495 |
| 1,329,444 | A | * | 2/1920 | Thompson | 42/78 |
| 1,536,164 | A | * | 5/1925 | Tainton | 102/504 |
| 2,372,383 | A | * | 3/1945 | Lee | 102/504 |
| 3,097,603 | A | | 7/1963 | Harper | |
| 3,154,016 | A | * | 10/1964 | Frey | 102/501 |
| 3,208,386 | A | | 9/1965 | Ross, Jr. | |
| 3,357,357 | A | | 12/1967 | Voss | |
| 3,401,637 | A | | 9/1968 | Briscoe | |
| 3,855,931 | A | | 12/1974 | Dardick | |
| 3,949,677 | A | | 4/1976 | Voss | 102/501 |
| 4,424,748 | A | * | 1/1984 | Schiff | 102/523 |
| 4,517,898 | A | | 5/1985 | Davis et al. | 102/514 |
| 4,700,630 | A | * | 10/1987 | Sullivan | 102/439 |
| 4,765,566 | A | | 8/1988 | Fixell et al. | 244/3.23 |
| 5,295,439 | A | | 3/1994 | Carbone | |

(Continued)

*Primary Examiner* — Samir Abdosh

(57) ABSTRACT

A gun firing method whereby multiple projectiles segments that are contained in a cartridge case are fired simultaneously to create a pattern on the target to increase the hit probability of the dispersion. Some of the multiple projectile segments are side by side within the cartridge case and have ends that are approximately 90 degrees to the central longitudinal axis of the cartridge. This causes the projectile segments to rotate around their for and aft axis upon leaving the gun barrel, improves their accuracy, and effectively provides the projectile segments with a higher ballistic coefficient and a higher sectional density, to strike the target at a higher velocity and with greater retained energy to efficiently penetrate the target.

6 Claims, 2 Drawing Sheets

(56) References Cited

U.S. PATENT DOCUMENTS

| | | | | |
|---|---|---|---|---|
| 5,505,137 | A | 4/1996 | Godefroy et al. | |
| 5,648,637 | A | 7/1997 | Clark, III | |
| 6,581,522 | B1 | 6/2003 | Julien et al. | 102/431 |
| 7,017,495 | B2 | 3/2006 | Sexton | 102/439 |
| 7,845,281 | B2 * | 12/2010 | Sexton | 102/439 |
| 8,141,493 | B1 * | 3/2012 | Kuchman | 102/439 |
| 2010/0282110 | A1 * | 11/2010 | Sexton | 102/438 |

* cited by examiner

METHOD FOR THE SIMULTANEOUS DISPERSION OF PROJECTILES

BACKGROUND ART

With the advent of guns and firearms much effort has been devoted to their perfection in the art of firing projectiles to hit specified targets. An important factor relating to the firing of a gun is the hit probability of the weapon.

A shotgun increases the hit probability by firing multiple projectiles in a random dispersion. An automatic weapon increases the hit probability by firing a random dispersion of projectiles toward a target, thereby covering a broad area around a target and assuring a greater chance of striking the target. Multiple projectiles can be fired simultaneously from a rifle or handgun to increase the hit probability of the weapon.

Much of the prior art for multiple projectile segment cartridges that fire multiple projectiles simultaneously from a single cartridge is from the late 1800's. Nolan (U.S. 221,249 Filed Nov. 4, 1879) uses a multiple projectile segment projectile. Most of the projectile segments that are side by side are held together temporarily after firing by "caps with spurs", "or soldering" on the forward pointed end, and a "beveled flange" on the aft end. The width of the dispersion is regulated somewhat by the deceleration of the projectile and the resulting force between the forward segments and the aft full caliber projectile segment which separate in flight. "The projectile can be used in either muzzle loading or breech loading arms . . . "

Rice (U.S. 216,974 Filed Jul. 1, 1879) uses a multiple projectile segment cartridge where pointed projectile segments are side by side. However, Rice apparently uses a smooth bore gun. The cartridge has a "conical or equivalent opening left at the point" and the projectile segments "move in different courses because of their particular shape and because of the action of the air, which spreads them apart as they are shot through it."

Both of these patents are similar to the applicant's invention, in that multiple projectile segment are fired. However the methods used in these patents, such as "caps with spurs" or "conical or equivalent opening left at the point," will not fire the projectile segments in accurate repeatable symmetrical patterns compared to the applicant's invention, or be as efficient in hitting the target with projectile segments that retain their velocity, and have a high sectional density because they are spinning around their fore and aft axis, which causes significantly higher terminal effects.

In 1952 a report for the U.S. Army by the Operations Research Office "Operational Requirements for an Infantry Hand Weapon" (3) analyzed firing a salvo of 5 projectiles in a diamond shaped pattern, and found the concept would greatly increase the hit probability of a weapon. With the "pattern-dispersion principle" each projectile had a predetermined hit point in the dispersion, was separated from the other projectiles, and the diamond shaped salvo efficiently maximized the lethal area, and. the hit probability of the dispersion. Graphs of the hit probability of the diamond shaped dispersion at different ranges and aiming errors, along with probability tables that predicted the number of projectiles that would strike the target at a given range were included in the report.

Several multi-barreled weapons that fire projectiles simultaneously to form patterns were tested during Project Salvo (1952-1962). These weapons were discontinued after Project Salvo. These weapons failed to provide a solution to the longfelt need of simultaneously firing a salvo of projectiles in a pattern.

The U.S. Army determined that the "pattern salvo weapon" or "dispersion weapon" would be very effective and recommended that the Ordinance Corp. proceed to develop a pattern salvo weapon for the Infantry. "Operational Requirements" (page 34) "the point of chief concern, however is to strive for the attainment of the pattern dispersion principle so that the greatest possible gains can be derived, and in that striving let the engineering difficulties argue for themselves." It was assumed that a weapon would be produced, and in "Operational Requirements" (pages 31-32) the "Basis of Issue" for the "dispersion weapon" that was recommended was" . . . 7 in every 10 infantry hand weapons should have the characteristics desirable for short range use."

However a practical "dispersion weapon" that fired the 5 shot diamond shaped pattern was never developed.

DISCLOSURE OF THE INVENTION

With the present invention, a square pattern of projectile strikes around the central projectile strike point that is randomly rotationally oriented, similar to the pattern called for in "Operational Requirements" can be fired from rifles and handguns at relatively short ranges. In contrast to prior art projectiles, in the applicant's invention, all the projectile segments in the cartridge spin around their fore and aft axis after firing. Since all of the projectiles in the salvo are spinning about their fore and aft axis in the applicant's invention, the ballistic coefficient of the individual projectile segments are higher, and they strike the target at a greater velocity than projectile segments that are tumbling as in the prior art cartridges. There is also a higher sectional density of the individual projectile segments which causes greater penetration of the target. The energy available by firing a rifle, or the limited energy available by firing a handgun, can be efficiently used by firing multiple projectile segments in a wide pattern, to greatly increase the hit probability of the gun. A wide salvo of projectile segments will compensate somewhat for imprecise aiming.

An optimum sized dispersion can be fired from a rifle or handgun to substantially increase the hit probability of the weapon in defensive situations that necessarily require fast reactions. Rifles and handguns that are used for personal defense are fired with short target exposure times and large aiming errors. The average aiming error for these short target exposure times can be taken into account, (1) and an optimal dispersion in which the standard radial deviation of the dispersion is 50%-100% of the aiming error can be fired. (2)

Many rifles and handguns will fire salvos generally within this optimal dispersion. Hit probability increases for the pattern dispersion salvos vary widely with the number of projectiles in the salvo, range, and aiming error, but many rifles and handguns, fired quickly in a defensive situation, will have on the order of a 60%-100% or more increase in hit probability by firing a pattern dispersion salvo compared to firing a single shot.[3]

Handguns are difficult to fire effectively. (In a study over an 8 year period the N.Y. Police hit their target only 18% of the time in shooting situations.) (Rand)

Footnote-1 "Rifle, Carbine, and Pistol Aiming Error as a Function of Target Exposure Time" 1955 report by the Operations Research Office for the U.S. Army.

Footnote 2 "Hit Probability on a Tank Type Target" 1966 report by the Frankford Arsenal. The report indicates the size of a dispersion to maximize the hit probability for a salvo of projectiles.

Footnote 3 "Operational Requirements for an Infantry Hand Weapon" has graphs of hit probabilities of a diamond shaped pattern dispersion salvo compared to one shot for several aiming errors. These graphs can be adjusted for the wider dispersions and shorter ranges of the present invention.

The invention is a system and a method for a simultaneous dispersion of projectiles in a symmetrical pattern from a gun. A large projectile of substantially normal size and weight is divided into multiple projectile segments, and positioned in a cartridge case. The invention consists of firing this large projectile which is made up of multiple projectile segments, and having these multiple projectile segments strike the target in a symmetrical pattern. Each one of the projectile segments has a predetermined strike point in relation to the other projectile segment's strike points. The pattern of strike points will be symmetrical but it will be randomly rotationally oriented. The multiple projectile segments that together make up the larger projectile consists of projectile segments that are side by side with a center of mass offset from the central longitudinal axis of the cartridge, and a standard projectile segment that has its center of mass along the central longitudinal axis of the cartridge, and is positioned at the forward end of the cartridge.

The centers of mass of the projectile segments that are side by side within the cartridge case are offset from the central longitudinal axis of the cartridge and upon firing the centrifugal force from the projectile segments spinning in the gun barrel, because of the rifling, imparts a force on the projectile segments at right angles to the gun barrel. Upon exiting the gun barrel, this force causes the projectile segments to diverge away from a trajectory that is in line with the centerline of the barrel. The amount of divergence of the side by side projectile segments compared to the standard projectile segment is uniform when firing identical cartridges from the same gun at the same range.

One of the main technical problems in the prior art for multi-projectile segment cartridges is that the projectile segments that are side by side tumble upon firing because they are unsymmetrical, have a center of mass substantially away from the centerline of the barrel, occupy only a fraction of the diameter of the barrel, and are sometimes fired at an angle of up to 45 mils. from the centerline of the barrel. These tumbling projectile segments are not accurate or efficient. (The applicant has fired projectile segments that are side by side and are in front of a full caliber projectile segment similar to the prior art cartridges. Projectile segments that together formed a pointed or round nosed bullet usually hit the target sideways or at an acute angle).

In the limited prior art of firing sub-caliber projectile segments that are side by side along with full caliber projectile segments, the prior art cartridges have full caliber projectile segments that push the multiple sub-caliber projectiles. It may have been thought that this was a more reliable way of firing sub-caliber and full-caliber projectiles simultaneously.

The applicant's invention reverses this placement, and the side by side multiple projectile segments are positioned behind the full caliber standard projectile segment.

The result of this placement is that the back end of the forward standard projectile segment provides one side of a housing for the projectile segments that are side by side and totally contained within the cartridge case. The projectile segments that are side by side in the applicant's invention have ends that are substantially perpendicular to the central longitudinal axis of the cartridge. This shape provides projectile segments that spin around their fore and aft axis after firing.

Upon firing the cartridge, the standard projectile segment and the multiple side by side projectile segments that make up the larger projectile travel as a unit down the barrel of the gun. The rifling in the barrel rotates this large projectile which is made up of multiple projectile segments. All the projectile segments have an equal rotational velocity as they exit the gun barrel. The forward standard projectile travels on a trajectory that is in line with the central axis of the gun barrel. The projectile segments that are side by side have a centrifugal force which acts on them at the exit point of the barrel. This is a result of having a center of mass that is offset from the central axis of the gun barrel. These side by side projectiles diverge away from the trajectory of the standard projectile. The angle of divergence depends mainly on the diameter of the projectile and the twist of the barrel. The rotation of the side by side projectile segments stabilizes them as they separate from the forward standard projectile segment, and continue on a trajectory at an angle to the standard projectile segment. The side by side projectile segments spin around their fore and aft axis and as a result they have less air resistance and a higher ballistic coefficient than projectiles that tumble. The salvo of projectiles forms a symmetrical pattern on the target.

The combined features of the forward standard projectile segment placement, and the aft projectile segments with ends that are substantially perpendicular to the central longitudinal axis of the cartridge and positioned side by side within the cartridge case mutually support each other to such a degree that the new technical result of all the projectile segments spinning around their fore and aft axis after leaving the gun barrel is achieved. This new function of the elements of the invention, standard projectile segments and projectile segments that are side by side spinning around their fore and aft axis after firing, provides a new synergy to the elements of the invention. This new synergy provides many beneficial effects.

The higher ballistic coefficient of the side by side projectile segments provides less air resistance and causes the projectile segments to strike the target at a higher velocity, compared to projectile segments from prior art cartridges that are tumbling. Projectile segments spinning around their fore and aft axis are more accurate and produce symmetrical patterns on the target to increase the hit probability of the dispersion. The sectional density of the projectile segments are higher which causes greater penetration of the target, and the terminal effects of the projectile segments are higher, because the sectional density can only be used to advantage when the projectile segments are spinning around their fore and aft axis and are not tumbling, as the prior art side by side projectiles.

The projectile segments that are side by side in the cartridge case spin around their fore and aft axis after leaving the gun barrel and continue to spin around their fore and aft axis after striking ballistic gelatin[4], which allows them to penetrate deeply. The number of revolutions of the projectile segments as they passed through the ballistic gelatin is easily observed through most of the projectile segment's path. These results from firing side by side projectile segments are new and unexpected.

Footnote 4 The gelatin that was used was substantially the same as ballistic gelatin that is commercially available.

Projectile segments that are the same weight and fired at the same velocity that have sharp edges penetrate on the order of 20% to 50% more than projectile segments that have a small radius on their edges. The applicant has used copper bullets to make these projectile segments that do not deform and cut a smooth path through ballistic gelatin. The cutting action of the sharp edge projectile segments and the resulting deeper penetration provides a new function to the elements of the invention.

The placement of the standard projectile segment forward in the applicant's invention makes the loading operation of the multiple projectile segment cartridges more reliable compared to the prior art cartridges. The forward profile of the cartridges in the prior art were made up of several projectile segments. The multiple faces of the projectile segments, and sometimes "caps with spurs" would be exposed, and it would seem this arrangement would be a much less robust design, and have a higher possibility of jamming in semi-automatic or automatic weapons, than the applicant's invention.

Another advantage the applicants invention has over the prior art is that the individual projectile segments have a shape that would lend them to be manufactured and assembled into cartridges more easily and less expensively.

The applicant's invention is very practical and can be used in many different kinds of weapons. The invention improves the symmetry of the patterns for a higher hit probability, maximizes the velocity and energy of the projectile segments at the target compared to prior art cartridges and increases the terminal effects of the dispersion.

BEST MODES FOR CARRYING OUT THE INVENTION

Figure 1:
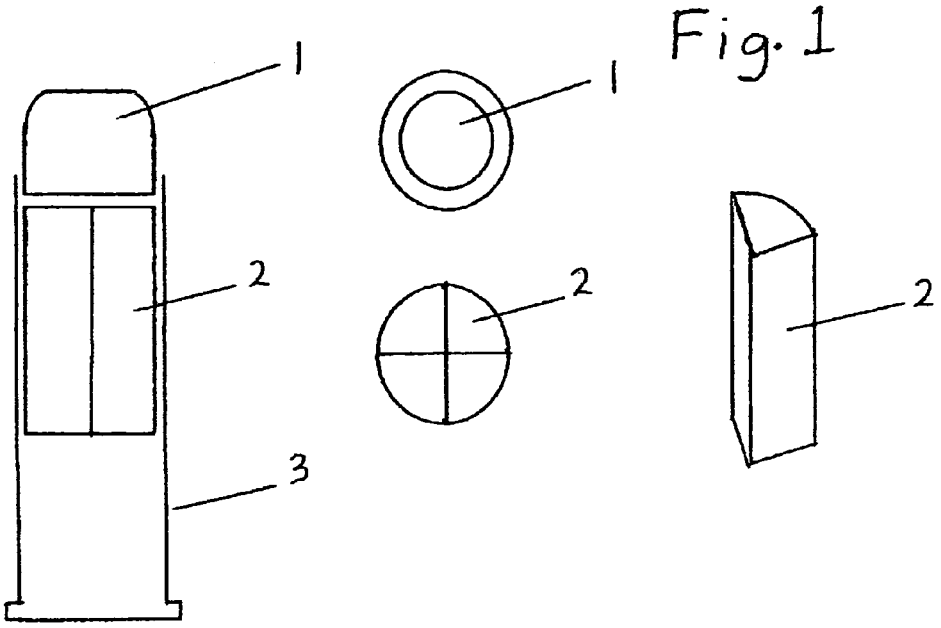
FIG. 1 is a five projectile segment cartridge with the standard projectile segment 1 located at the forward end of the cartridge. Behind the standard projectile segment 1 there are four aft projectile segments 2 positioned side by side in the cartridge case 3. Each of the four aft projectile segments 2 each has substantially perpendicular ends and occupies a 90 degree sector of the cartridge case 3.
Figure 2:
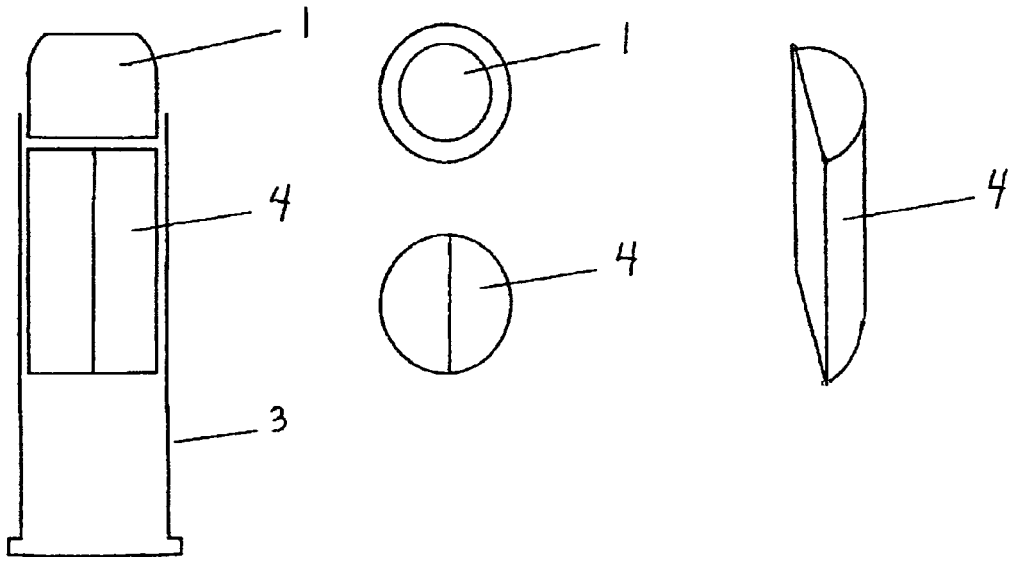
FIG. 2 is a three projectile segment cartridge with the standard projectile segment 1 located at the forward end of the cartridge. Behind the standard projectile segment 1 are two aft projectile segments 4 positioned side by side in the cartridge case 3. Each of the two aft projectile segments has substantially flat ends and occupies a 180 degree sector of the cartridge case 3.
Figure 3:
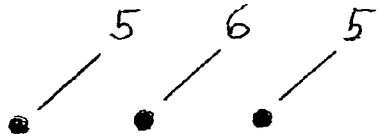
FIG. 3 is a pattern of projectile strikes on a target from the cartridge in FIG. 2. The Two aft projectile segments 4 strike the target at strike points 5 on either side of the central strike point 6. The pattern of strike points will be randomly rotationally oriented with a random rotational orientation of the cartridge in the chamber of the gun.
Figure 4:
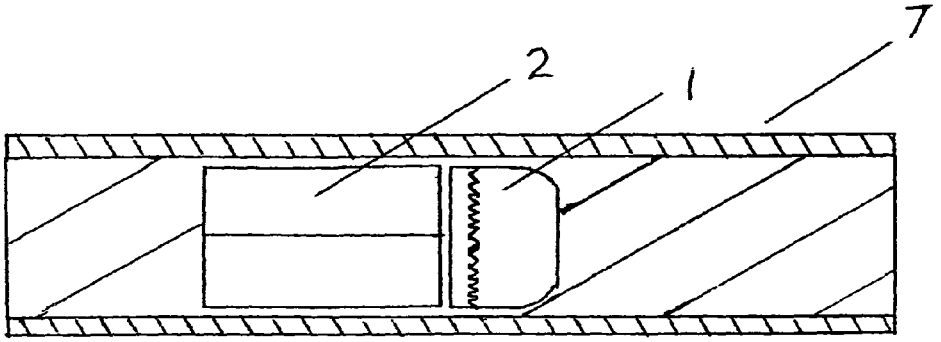
FIG. 4 is a rifled barrel 7 containing the projectile segments from FIG. 1. There are four projectile segments 2 behind the standard projectile segment 1.
Figure 5:
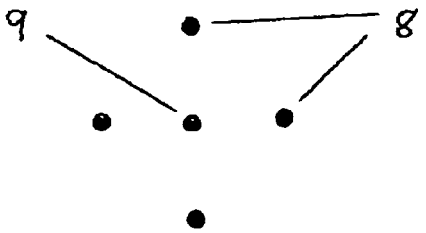
FIG. 5 is a pattern of five projectile segment strikes on a target from the cartridge in FIG. 1. The four aft projectile segments 2 strike the target at strike points 8 on either side, and above and below the central strike point 9. The pattern of projectile segments 2 strikes in FIG. 5 will be randomly rotationally oriented with a random rotational orientation of the cartridge in the gun.

Rifles that fire larger caliber straight sided cartridges are particularly well suited to firing a 5 projectile segment randomly oriented pattern of projectile segments for self defense or possibly for hunting. In many cases the energy of each projectile segment in a five projectile segment dispersion from a rifle will approximate that of a handgun bullet. A 44 magnum lever action rifle will fire a five projectile segment cartridge with four 50 grain aft projectile segments side by side (when using the available copper bullets that will not deform and keep a sharp edge the quarter cylinder shaped projectile segments will be 40 grains). A forward 80 grain standard projectile segment can be included in the 5 projectile segment cartridge. Prototype 5 projectile segment cartridges can be made by using hand tools with simple jigs to cut and file total metal jacket bullets or solid copper bullets into projectile segments with the proper dimensions. Total metal jacket bullets or bullets with a similar construction are necessary so that the lead core is bonded to the jacket of the bullet. After the projectile segments are positioned in the cartridge case with the correct amount of powder a firm crimp is required on the forward projectile segment cannelure. With a 44 magnum lever action rifle with a 1 in 30 twist, the randomly rotationally oriented 5 projectile segment cartridge will produce a symmetrical pattern of strike points that is a square around the central strike point. The square will be randomly rotationally oriented, and the dispersion of projectiles will be approximately 20 inches wide at 40 feet, depending on the rotational orientation of the square pattern.

The size of the square pattern at 40 feet is consistent for subsequent rounds. The imprint of the side by side projectiles at the corners of the square will be ¼ pie shaped because of the projectile segments spinning about their fore and aft axis.

INDUSTRIAL APPLICABILITY

The cartridges can be manufactured efficiently by ammunition companies using many existing methods and machines for a large part of the manufacturing process. New steps would have to be incorporated for the manufacture of the projectile segments and their assembly. Forming the projectile segments and using electroplating or a process similar to the manufacture of total metal jacket bullets could be considered, along with using copper projectile segments.

The multiple projectile segment cartridge fires a wide dispersion of projectiles in a symmetrical pattern. These projectiles segments spin around their fore and aft axis after firing and efficiently strike the target with maximum velocity and greater terminal effects. The pattern dispersion significantly increases the hit probability of the weapon especially at short target exposure times with high aiming errors.

The invention produces symmetrical patterns of projectile segments that are substantially shaped like a half cylinder or a quarter cylinder or similar shapes that spin around their fore and aft axis after firing, and continue to spin around their fore and aft axis after striking the target. The invention increases the hit probability of the gun and efficiently uses the available energy to fire multiple projectiles at the target in a symmetrical pattern.

The invention claimed is:

1. A system to improve the effectiveness of a dispersion of projectiles and to improve the hit probability of said dispersion on a target comprising;

a gun having a rifled barrel;

a projectile having a main body, having a front end, a back end, and a side, positioned within a cartridge case, with a central longitudinal axis along the center of said cartridge case;

wherein said projectile is divided into at least three projectile segments;

wherein at least two of said projectile segments have centers of mass that are offset from the said central longitudinal axis of the cartridge and are positioned side by side totally within said cartridge case and said front ends and said back ends are substantially perpendicular to said central longitudinal axis of the cartridge;

wherein a standard projectile segment, that has its center of mass along said central longitudinal axis of the cartridge is positioned at the forward end of said cartridge case;

whereby said standard projectile segment positioned forward promotes reliable loading, and upon firing simultaneously said forward standard projectile segment and at least two said projectile segments with ends substantially perpendicular to said central longitudinal axis of the cartridge that are positioned side by side within said cartridge case, said projectile segments that were side by side thereby rotate around their fore and aft axis after leaving the gun barrel, providing accurate projectile segments that effectively have a higher ballistic coefficient, and a higher sectional density, and therefore strike said target at a higher velocity and with greater retained energy, than projectiles that tumble, to efficiently penetrate said target to a greater depth and to create an accurate pattern on said target to increase the hit probability of said gun.

2. The system of claim 1 wherein;

four said projectile segments that are side by side with said centers of mass offset the same distance from said central longitudinal axis of the cartridge are oriented radially at vectors of orientation substantially perpendicular to the said central longitudinal axis of the cartridge, and upon firing with said forward standard projectile segment a pattern is created that is substantially a square around the central strike point.

3. The system of claim 1 further including;

said projectile segments that are side by side with said centers of mass offset a distance from said central longitudinal axis of the cartridge have substantially sharpened edges which cause a cutting action of said projectile segments for deeper penetration of said target.

4. A method to improve the effectiveness of a dispersion of projectiles and to improve the hit probability of said dispersion on a target comprising;

providing a gun with a rifled barrel;

providing a projectile having a main body, having a front end, a back end, and a side, positioned within a cartridge case, with a central longitudinal axis along the center of said cartridge case;

dividing said projectile into at least three projectile segments;

positioning side by side in said cartridge case at least two of said projectile segments that have centers of mass that are offset from the said central longitudinal axis of the cartridge;

providing at least two said projectile segments that have centers of mass that are offset from said central longitudinal axis of the cartridge, and are positioned side by side totally within said cartridge case, with said front ends and said back ends of said projectile segments that are substantially perpendicular to said central longitudinal axis of the cartridge;

positioning a standard projectile segment, that has its center of mass along said central longitudinal; axis of the cartridge, at the forward end of said cartridge case;

loading said cartridge with said standard projectile segment positioned forward, and upon firing simultaneously said forward standard projectile segment, and at least two said projectile segments with ends substantially perpendicular to said central longitudinal axis of the cartridge that are positioned side by side within said cartridge case, said projectile segments that were side by side thereby rotate around their fore and aft axis upon leaving the gun barrel, providing accurate projectile segments that effectively have a higher ballistic coefficient, and a higher sectional density, and therefore strike said target at a higher velocity and with greater retained energy, than projectiles that tumble to efficiently penetrate said target to a greater depth and to create an accurate pattern on said target to increase the hit probability of said gun.

5. The method as recited in claim 4 wherein;

Positioning four said projectile segments that are side by side with said centers of mass offset the same distance from said central longitudinal axis of the cartridge and oriented radially at vectors of orientation substantially perpendicular to the central longitudinal axis of the cartridge, along with said forward standard projectile segment, provides a pattern upon firing said gun of five strike points that is substantially a square around the central strike point.

6. The method as recited in claim 4 further including;

Providing said projectile segments that are side by side with said centers of mass offset a distance from said central longitudinal axis of the cartridge with substantially sharpened edges, which cause a cutting action of said projectile segments for deeper penetration of said target.

* * * * *